US007396179B2

(12) United States Patent
Lange et al.

(10) Patent No.: US 7,396,179 B2
(45) Date of Patent: Jul. 8, 2008

(54) WRITING INSTRUMENT INCLUDING A VALVE FEEDER DEVICE

(75) Inventors: Didier Lange, Saint Leonard (FR); Franck Rolion, Belloy en France (FR); Vincent Bedhome, Desvres (FR)

(73) Assignee: Société BIC, Clichy, Cedex (FR)

( * ) Notice: Subject to any disclaimer, the term of this patent is extended or adjusted under 35 U.S.C. 154(b) by 0 days.

(21) Appl. No.: 10/597,141

(22) PCT Filed: Jan. 28, 2005

(86) PCT No.: PCT/FR2005/000192

§ 371 (c)(1),
(2), (4) Date: Apr. 28, 2007

(87) PCT Pub. No.: WO2005/092636

PCT Pub. Date: Oct. 6, 2005

(65) Prior Publication Data

US 2007/0217859 A1 Sep. 20, 2007

(30) Foreign Application Priority Data

Feb. 24, 2004 (FR) ..... 04 01846

(51) Int. Cl.
*B43M 11/02* (2006.01)

(52) U.S. Cl. ..... 401/218

(58) Field of Classification Search ..... 401/205–206, 401/208, 218–220, 263, 264
See application file for complete search history.

(56) References Cited

U.S. PATENT DOCUMENTS

| | | | | |
|---|---|---|---|---|
| 4,723,860 | A * | 2/1988 | Giblin et al. | 401/208 |
| 5,967,688 | A * | 10/1999 | Hu | 401/206 |
| 2003/0099501 | A1 | 5/2003 | Fukushima et al. | |

FOREIGN PATENT DOCUMENTS

| | | |
|---|---|---|
| DE | 102 28 553 A1 | 1/2004 |
| GB | 643 626 | 9/1950 |
| GB | 643626 | 9/1950 |
| GB | 795 304 | 5/1958 |
| GB | 795304 | 5/1958 |
| JP | 7-214968 | 8/1995 |

* cited by examiner

*Primary Examiner*—Huyen Le
(74) *Attorney, Agent, or Firm*—Jones Day

(57) ABSTRACT

A writing instrument that includes a body provided with an ink reservoir; an inker element mounted at one end of the body; and a feeder device. The feeder device includes a duct that connects the reservoir to the inker element and opens out into the reservoir via an opening. The feeder device also includes a valve that includes a tab received in the duct, the tab being extended by a head.

24 Claims, 6 Drawing Sheets

FIG. 1
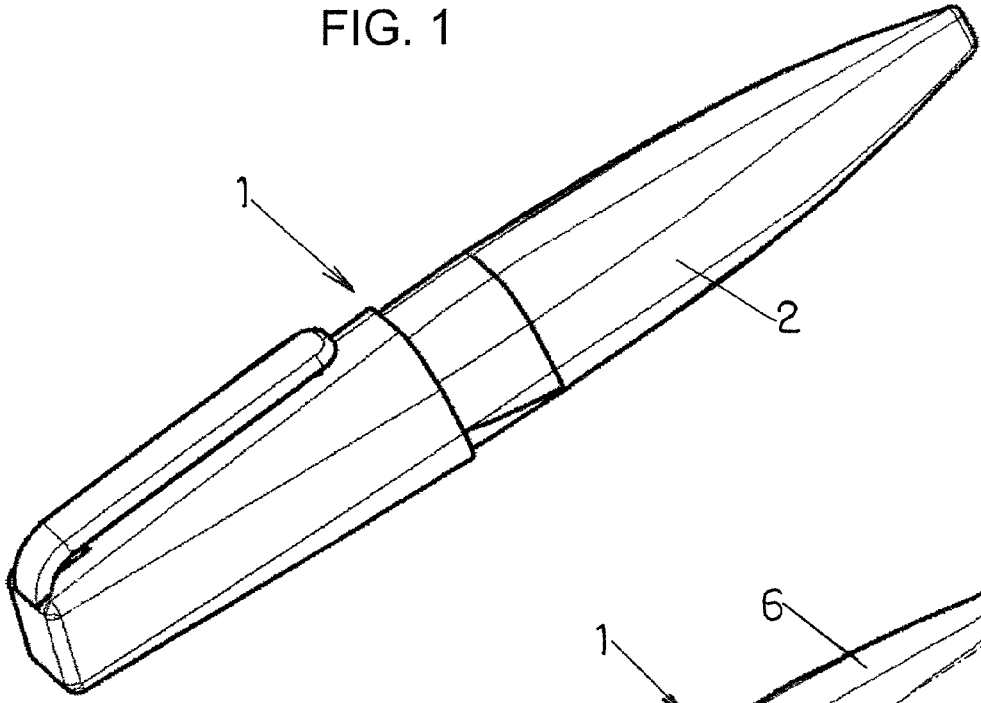
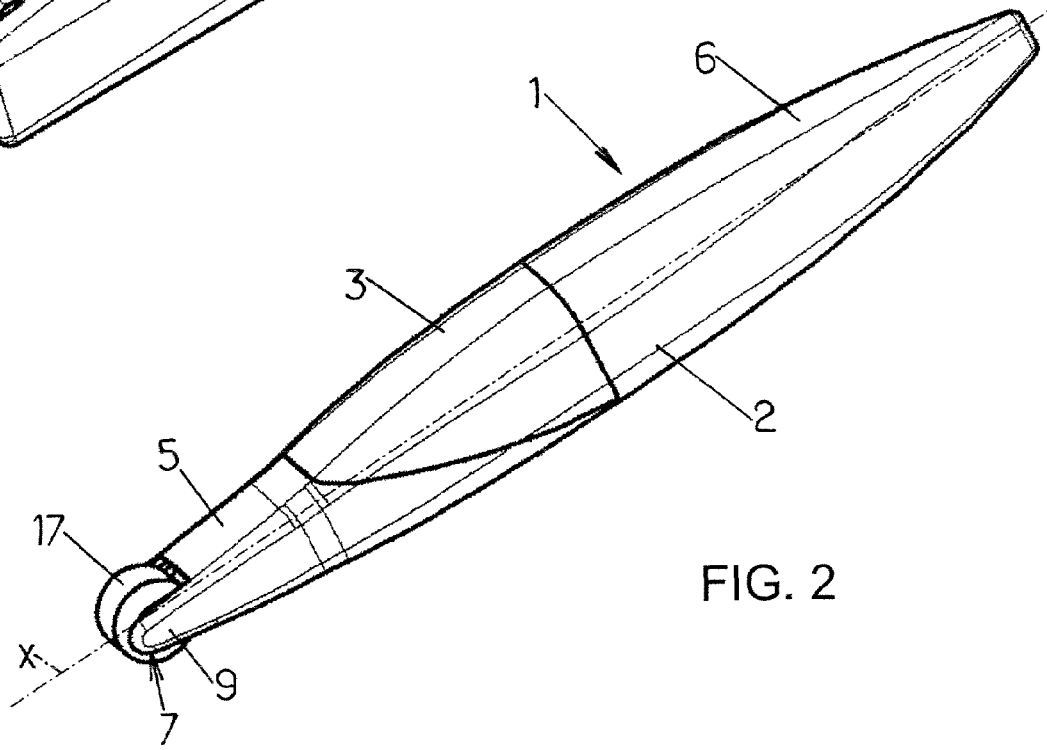
FIG. 2

WRITING INSTRUMENT INCLUDING A VALVE FEEDER DEVICE

FIELD OF INVENTION

This application is a national stage application of PCT/FR2005/000192, filed on Jan. 28, 2005.

The invention relates to writing instruments.

BACKGROUND OF THE INVENTION

The Japanese patent application published under the No. JP-07-214968 discloses a writing instrument comprising an ink reservoir, a roller, a passage connecting the reservoir to the roller, and a valve mounted to move between a closed position in which it closes the passage, and open position in which it puts the reservoir into communication with the roller. A porous element is interposed in the passage between the roller and the valve, which valve is pierced by a hole that serves, in the open position, to allow the ink to flow from the reservoir towards the porous element, which porous element in turn inks the roller.

That type of writing instrument can give satisfaction, but it nevertheless presents a certain number of drawbacks.

Firstly, as can be seen in FIGS. 1 and 2 of the above-mentioned application, part of the roller is received in the passage provided for passing the flow of ink. In order to allow the roller to rotate freely, it can be understood that it is necessary to provide clearance between the roller and the passage. This leads to a risk of ink that is too fluid penetrating into said clearance and overflowing the contact zone between the roller and the support against which the roller is pressed, thereby leading to marks and smudges.

Furthermore, it can happen that the valve and/or the porous element become jammed in the passage, either in the closed position (in which case the ink no longer flows), or else in the open position (in which case the instrument leaks permanently), both to the detriment of proper operation of the writing instrument.

SUMMARY OF THE INVENTION

The invention seeks to solve the above-mentioned drawbacks, by proposing a writing instrument that presents increased reliability and writing precision.

To this end, the invention provides a writing instrument comprising:

- a body provided with an ink reservoir;
- an inker element mounted on the body; and
- a feeder device comprising:
  - a duct connecting the reservoir to an inker element and opening out into the reservoir via an opening, the duct presenting an inside wall; and
  - a valve having a tab received in said duct, the tab being extended by a head;
- the valve is mounted to slide between a closed position in which said head is pressed against a shoulder bordering said opening so as to prevent ink from flowing, and an open position in which the head is located at least in part away from the shoulder so as to enable ink to flow through the opening, the instrument being characterized in that a gap is formed between the tab and the inside wall of the duct, and in that the tab projects from the duct towards the inker element.

As a result, the ink runs by capillarity from the valve onto the inker element.

This reduces the risk of ink overflowing from the inker element, to the benefit of writing precision.

Furthermore, the gap between the valve and the duct reduces the risk of the valve jamming in the duct, to the benefit of the reliability of the writing instrument.

The valve is preferably made of, or is coated in, a hydrophobic material, such as silicone.

Furthermore, the duct is rectangular in section, for example, while the tab is pyramid-shaped.

In an embodiment, the feeder device comprises a sleeve in which said opening is formed, which sleeve is engaged on a nozzle of the reservoir and has the valve mounted therein.

The valve may be provided with through holes formed in the head in the vicinity of the tab.

In an embodiment, the holes are in the form of slots having parallel edges, the valve tab presenting a peripheral portion that is stationary relative to the body and a central portion including the tab, said central portion being movable between a closed position in which the edges of each slot coincides, and an open position in which the edges of the slots are offset so as to allow the ink to flow.

The inker element, being in continuous contact with the valve tab, is preferably movable between a writing position in which it urges the valve towards its open position in order to allow the ink to flow, and a rest position in which it enables the valve to occupy its closed position.

By way of example, the inker element is secured on a support mounted to slide relative to the body between a writing position in which the inker element urges the valve towards its open position to allow the ink to flow, and a rest position in which the inker element enables the valve to occupy its closed position.

In an embodiment, the support is urged towards its rest position by a return spring, e.g. comprising a spring blade integrated in the support and bearing against a wall that is stationary relative to the body.

The body of the instrument extends along a main axis, and the inker element is constituted, for example, by a roller mounted to rotate about an axis that is perpendicular to the main axis of the body.

In an embodiment, the inker element is in peripheral contact with a writing roller mounted to rotate about an axis parallel to the axis of the intermediate roller, and suitable for coming into contact with a writing medium.

The diameter of the intermediate roller is also preferably smaller than the diameter of the writing roller.

Other objects and advantages of the invention appear in the light of the following detailed description made with reference to the accompanying drawings.

BRIEF DESCRIPTION OF THE DRAWINGS

FIG. 1 is a perspective view of a writing instrument of the invention, the instrument being closed by a cap;

FIG. 2 is a view of the FIG. 1 writing instrument, without the cap;

FIGS. 1 to 4 show a writing instrument 1 comprising a body 2 that is elongate along a main axis X and that is provided with a reservoir 3 containing a liquid ink 4 that can be seen in particular in FIG. 4, where a portion of the reservoir 3 is cut away.

Figures 3, 4:
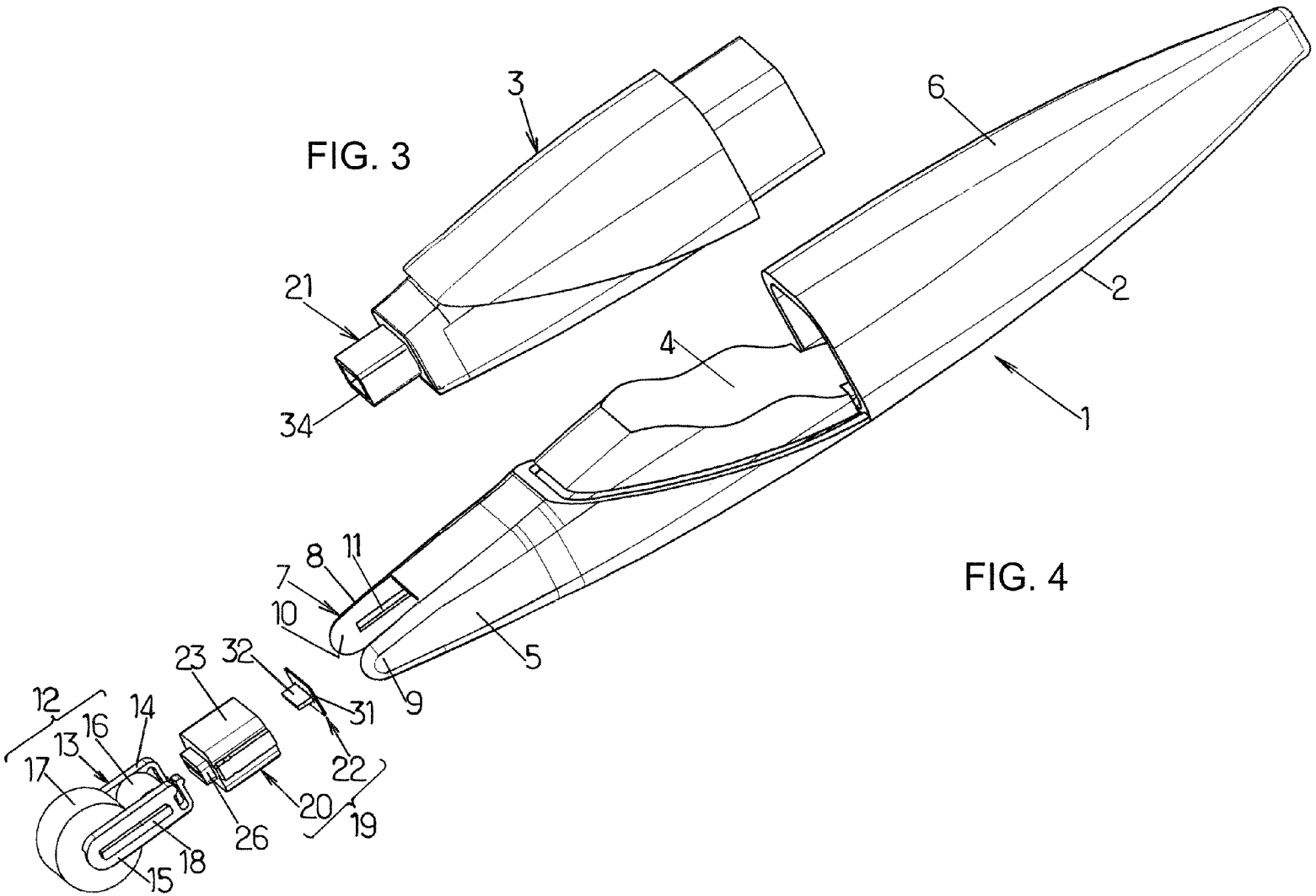
FIG. 3 is a perspective view showing a portion of the writing instrument of the preceding figures.
FIG. 4 is a partially cutaway exploded perspective view showing the FIG. 2 writing instrument.
Figure 5:
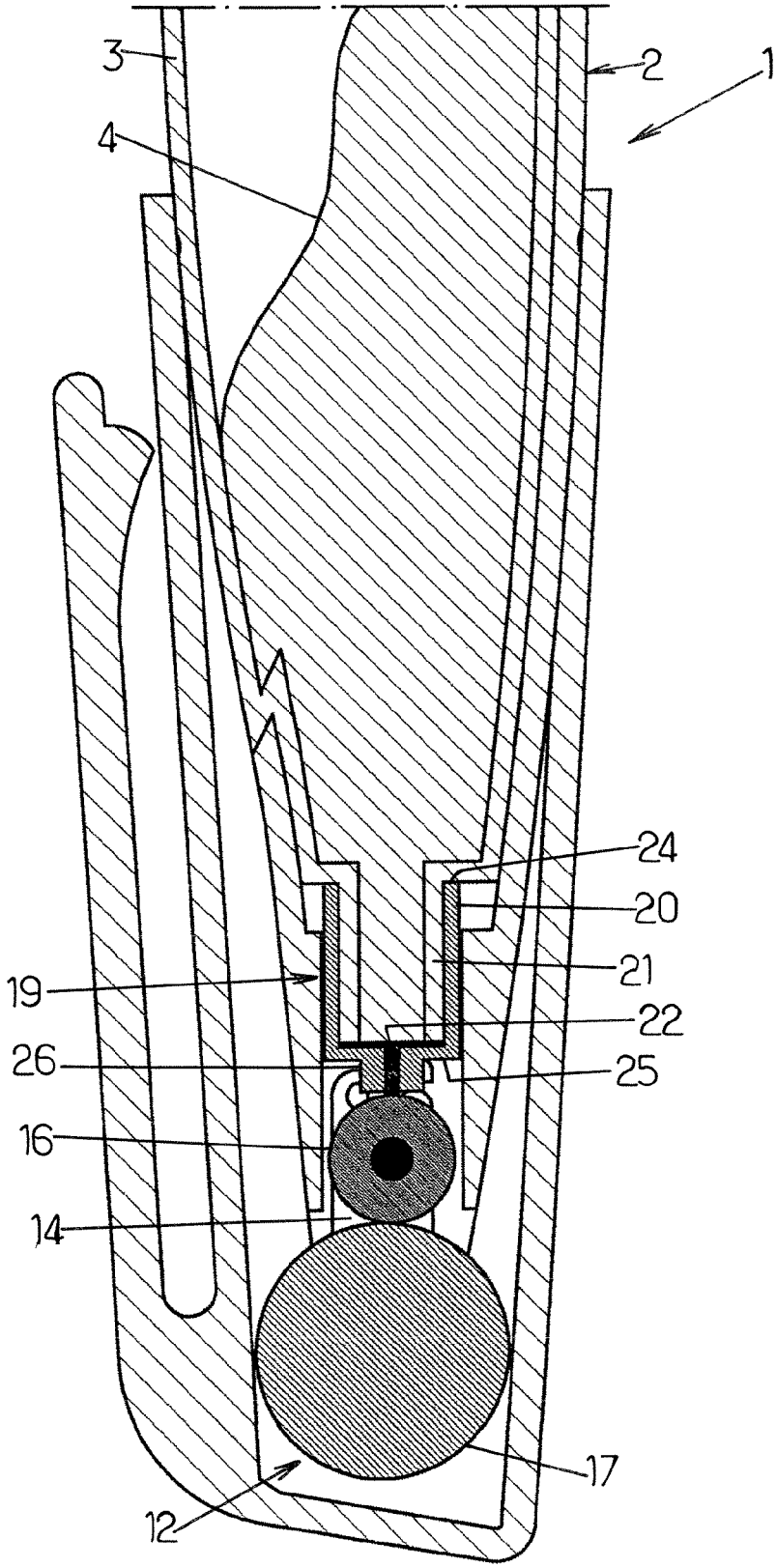
FIG. 5 is an elevation view, partially in section, showing the FIG. 2 writing instrument.

As can be seen in FIGS. 3 to 5, the reservoir 3 is in the form of a removable and replaceable cartridge that is fitted between a front portion 5 and a rear portion 6 of the body 3, in such a manner that the surfaces of the reservoir 3 and of said front and rear portions 5 and 6 are flush when the body 2 is assembled (FIG. 2).

As can be seen in FIG. 4 in particular, the front portion 5 presents, at its end remote from the rear portion 6, a front end 7 shaped as a fork having two parallel arms 8 and 9, each having in an inner face 10 a groove 11 extending parallel to the main axis X.

The instrument 1, which is specifically a marker or an overliner, also includes a writing device 12 comprising a support 13 having two prongs 14, 15 extending substantially parallel to the main axis X and having an inker roller 16 and a writing roller 17 rotatably mounted between them, both rollers being cylindrical in shape.

The inker roller 16 and the writing roller 17 are mounted to rotate about first and second axes A1 and A2 respectively that are substantially parallel to each other and perpendicular to the main axis X.

Figure 6:
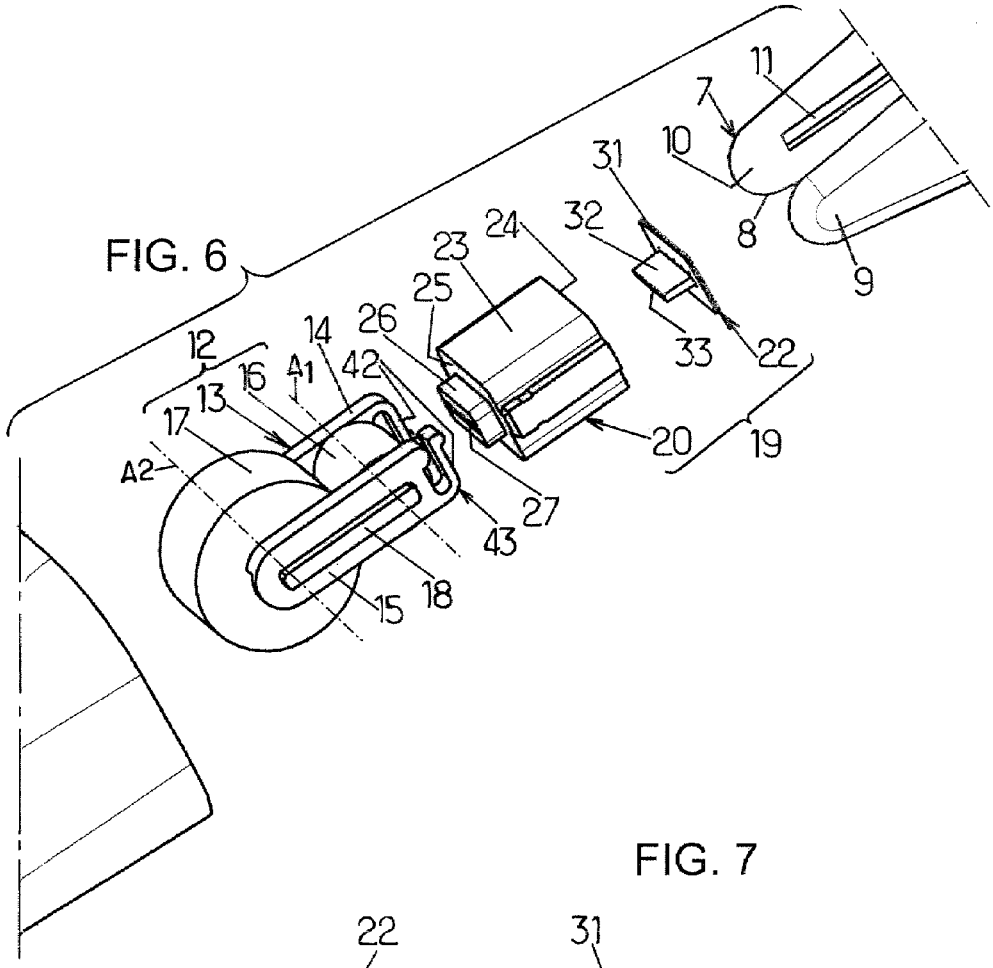
FIG. 6 is an exploded perspective view showing a detail of the FIG. 4 writing instrument.

As can be seen in FIGS. 5 and 6, the diameter of the inker roller 16 is smaller than the diameter of the writing roller 17.

Each prong 14, 15 presents a projecting spline 18 that extends parallel to the main axis X. When assembled, the device 12 is mounted at the front end 7 of the body 2, the support 13 being engaged in the fork 7 and the splines 18 being received in the corresponding grooves 11. The grooves are longer than the splines 18 so as to allow the device 12 to move axially, for reasons that are explained below.

The writing instrument 1 further includes a feeder device 19 having a sleeve 20 that engages on a nozzle 21 provided on the reservoir 3, and a valve 22 engaged in the sleeve 20.

The sleeve 20 presents a hollow rectangular body 23 open at a rear end 24, whereby it engages on the nozzle 21, and closed remote from said rear end 24 by an end wall 25.

The sleeve 20 also presents a chimney 26 that projects from the end wall 25, away from the rear end 24. The chimney 26 is pierced by a through duct 27 of rectangular section.

The duct 27 presents an inside wall 28 and it opens out at its reservoir end via an opening 29 bordered by a shoulder formed by a face 30 of the end wall 25 that faces towards the reservoir 3.

The valve 22 presents a T-shaped profile and comprises a substantially flat edge 31 that extends perpendicularly to the main axis X, being extended by a tab 32 that projects from the head 31 parallel to the main axis X, the tab 32 being terminated remote from the head 31 by an end 33.

The valve 22 is engaged in the sleeve 20 firstly with its tab 32 received in the duct 27, and secondly with its head 31 engaged between the end wall 25 and a front end 34 of the nozzle 21.

The respective sections of the tab 32 and of the duct 27 are selected in such a manner that a gap 35 is left between them through which the ink 4 can flow, as described below.

Figure 8:
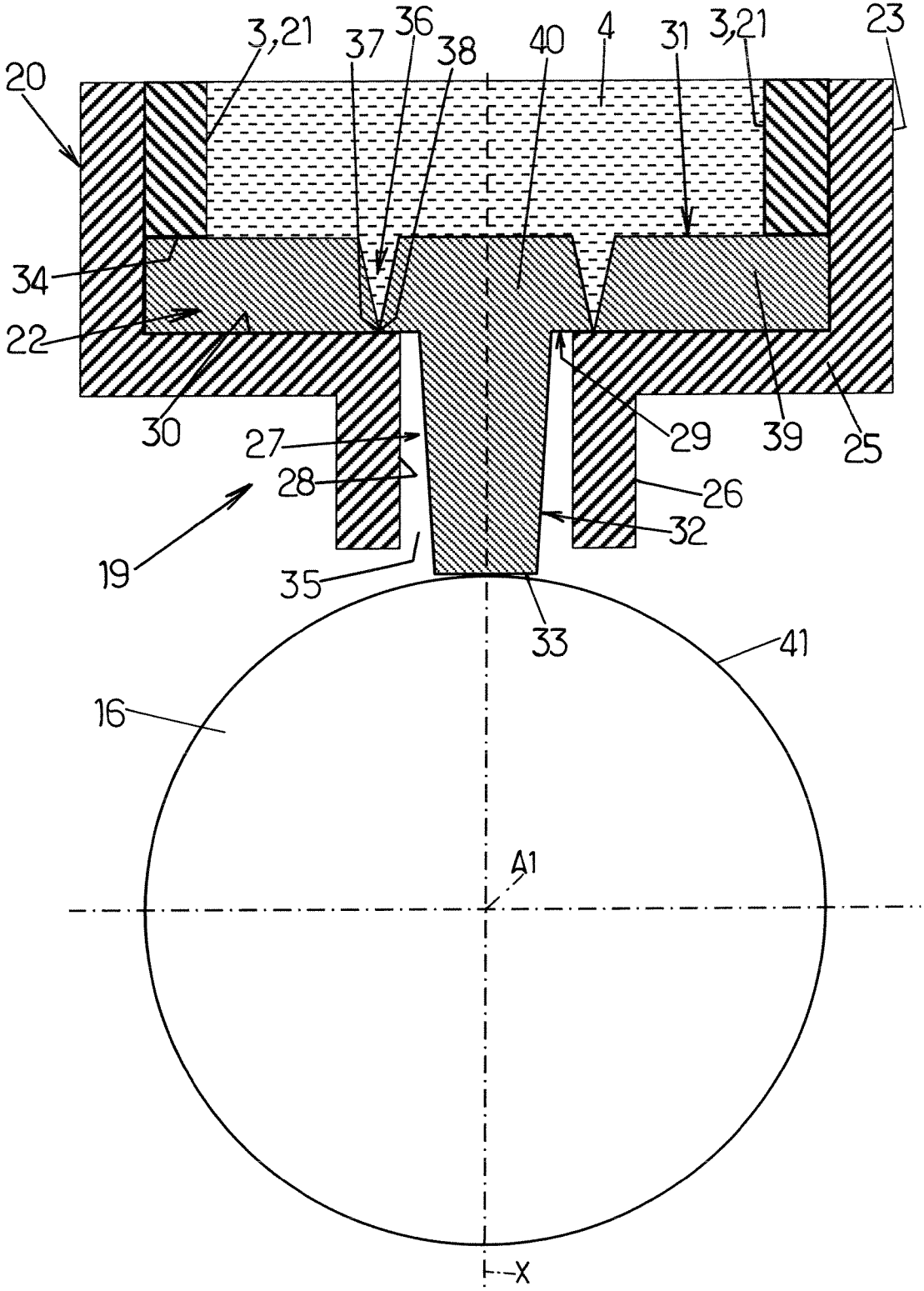
FIG. 8 is a detail view in section and in elevation showing the writing instrument with the valve in a closed position.
Figure 9:
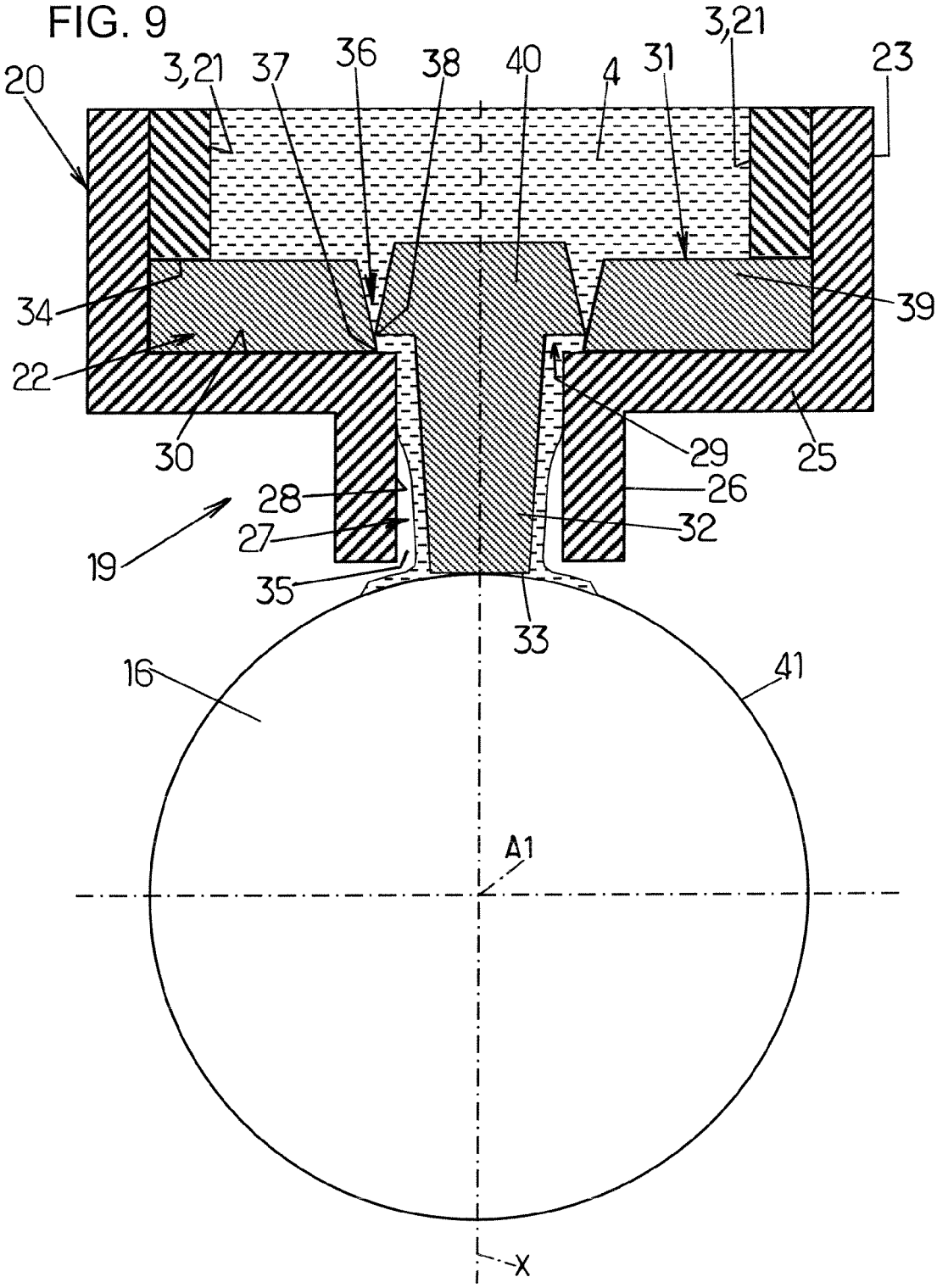
FIG. 9 is a view analogous to FIG. 8, in which the valve is in an open position.

Although the section of the duct 27 is constant, the tab 32 is in the form of a truncated pyramid, as can be seen in FIGS. 8 and 9, with its section perpendicular to the main axis X tapering from its junction with the head 31 towards its end 33 so that the width of the gap 35 increases on going away from the reservoir 3.

At its end 33, the tab 32 presents a width L that is less than or equal to the width of the inker roller 16 (measured parallel to its axis of rotation A1).

In addition, the respective lengths of the chimney 26 and of the tab 32 are selected so that the tab 32 projects beyond the duct 27 at its end remote from the reservoir 3, as can be seen in FIGS. 8 and 9.

The valve 22 is also provided with through holes 36 formed in the head 31 beside and on either side of the tab 32.

Figure 7:
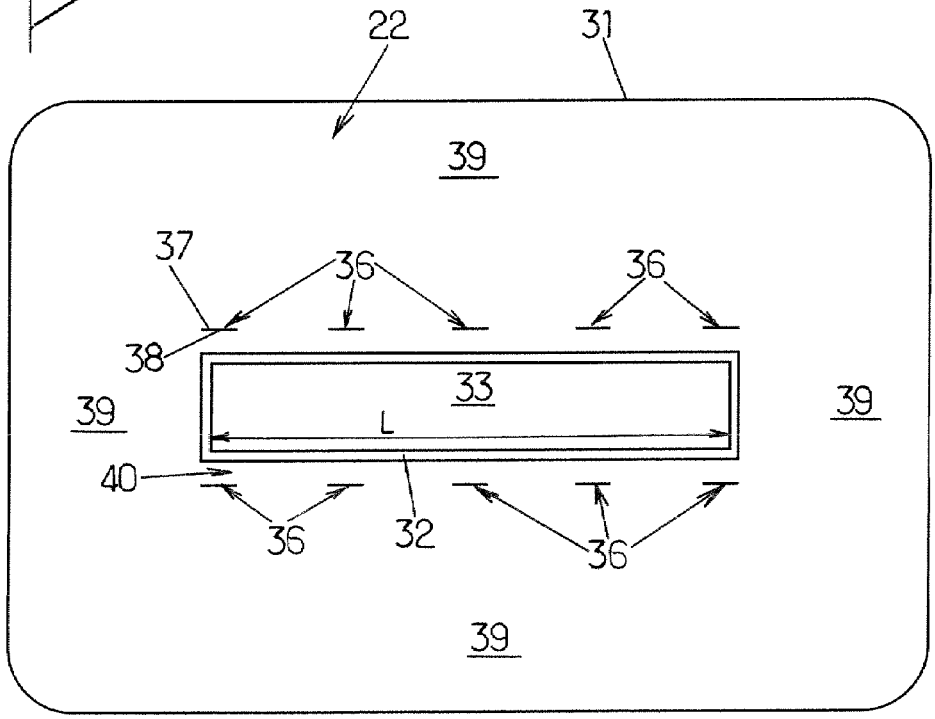
FIG. 7 is a plan view of a valve for a writing instrument as shown in FIG. 4.

In an embodiment shown in FIGS. 7 to 9. these holes 36 are in the form of slots having parallel edges 37, 38.

On the valve 22, these slots 36 define firstly a peripheral portion 39 formed by a zone of the head 31 that is situated around the slots 36, and secondly a central portion 40 situated between the slots 36 and including the tab 32.

The valve 22 is movable along the main axis X between:

- a closed position in which the edges 37, 38 of each slot 36 coincide, the portion of the head 31 situated beside the tab 32 being pressed against the shoulder 30 (FIG. 8); and
- an open position in which the edges 37, 38 of the slots 36 are offset, the central portion 40 being pushed towards the inside of the reservoir 3, the portion of the head 31 situated in the vicinity of the tab 32 being spaced apart from the shoulder 30 (FIG. 9).

Whatever the position of the valve 22, the peripheral portion 39 pinched between the end wall 25 and the end 34 of the nozzle 21 is stationary relative to the body 2. Thus, the valve 22 passes from its closed position to its open position, and vice versa, by deforming elastically.

As a result, the central portion 40 of the valve 22 is continuously urged towards its closed position by the elasticity of the material from which the valve 22 is made.

The valve 22 is made of, or is coated in, a hydrophobic material for reasons that are explained below. In a first embodiment, the valve 22 comprises a core made of a plastics material such as polypropylene, or of an elastomer, together with a silicone covering, where the hydrophobic properties of silicone are well known. In a second embodiment, the valve 22 is made entirely out of silicone.

As can be seen in FIG. 5, the writing device 12 is also adjacent to the feeder device 19, the inker roller 16 being in contact with the tab 32 via a peripheral surface 41.

More precisely, the writing device 12 is mounted to slide relative to the body 2 between:

- a writing position, shown diagrammatically in FIG. 9, which it occupies when a user presses the instrument 1 against a writing medium (not shown), in which position the inker roller 16 urges the valve 22 towards its open position; and
- a rest position shown in FIGS. 5 and 8, in which the inker roller 16 enables the valve 22 to occupy its closed position;

The writing device 12 is continuously urged towards its rest position by means of a return spring in the form of a pair of spring blades 42 cantilevered out from the rear end 43 of each prong 14, 15 and bearing continuously against the end wall 25 on either side of the chimney 26.

When the writing device 12 is in the rest position (as shown in FIG. 5), the valve 22 is itself in the closed position and closes the duct 27 so as to prevent ink 4 from flowing from the reservoir towards the inker roller 16.

However, when the writing device 12 is in the writing position, the inker roller 16, which moves back towards the reservoir 3, causes the valve 22 to open, so ink 4 can flow from the reservoir 3 towards the inker roller 16, passing through the slots 36 whose edges 37, 38 are spaced apart, and then through the opening 29 and the duct 27.

Given the hydrophobic nature of the coating of the valve 22 and the enlargement of the gap 35, the ink 4 separates from the inside wall 28 of the duct 27, and flows by capillarity against the flanks of the tab 32 (FIG. 9), and then inks the surface 41 of the inker roller 16 which, being continuously in peripheral contact with the writing roller 17, is entrained to rotate about its axis A1 in the opposite direction to the writing roller.

In addition, since the tab 32 projects beyond the duct 27, the inker roller 16 is in contact only with the end 33 thereof, such that the spreading of the ink 4 is restricted to the intermediate vicinity of the end 33. This minimizes the risk of the ink 4 overflowing onto the chimney 26 with too great a quantity of ink flowing onto the inker roller 16. This risk is particularly limited, as mentioned above, by the width of the tab 32 at its end 33 being smaller than the width of the inker roller 16. This results in the ink 4 being spread with great precision on the inker roller 16.

Rotation of the inker roller 16 allows the ink 4 to be spread uniformly over its peripheral surface 41, and by rotating contact with the writing roller 17 allows the ink 4 to be transferred uniformly thereto.

The presence of the inker roller 16, which forms an intermediate support for the ink 4 between the feeder device 19 and the writing roller 17, serves to limit the risks of the ink 4 overflowing. In addition, because the diameter of the inker roller 16 is smaller than that of the writing roller 17, it is possible to achieve a measured flow of ink from the inker roller 16 towards the writing roller 17, thereby minimizing any risk of ink being projected (i.e. splashing) during rotation of the rollers 16, 17.

The invention claimed is:

1. A writing instrument comprising:

a body provided with an ink reservoir;

an inker element mounted on said body; and a feeder device comprising:

a duct connecting the reservoir to said inker element and opening out into the reservoir via an opening, said duct presenting an inside wall; and a valve having a tab received in said duct, the tab being extended by a head, wherein said valve is mounted to slide between a closed position in which the head is pressed against a shoulder bordering the opening so as to prevent ink from flowing, and an open position in which the head is located at least in part away from the shoulder so as to enable ink to flow through the opening, wherein a gap is formed between the tab and the inside wall of the duct, wherein the tab projects from said duct towards said inker element, wherein said inker element is movable between a writing position in which it urges said valve towards an open position to allow the ink to flow, and a rest position in which it allows said valve to occupy a closed position, and wherein said inker element is secured on a support mounted to slide relative to said body between a writing position in which said inker element urges said valve towards an open position to allow the ink to flow, and a rest position in which said inker element enables said valve to occupy a closed position.

2. A writing instrument according to claim 1, in which said valve is made of, or is coated in, a hydrophobic material.

3. A writing instrument according to claim 2, in which said valve is made of, or coated in, silicone.

4. A writing instrument according to claim 3, in which said duct is rectangular in section, the tab being pyramid-shaped.

5. A writing instrument according to claim 3, in which said feeder device comprises a sleeve in which the opening is formed, wherein the sleeve is engaged on a nozzle of the reservoir and has said valve mounted therein.

6. A writing instrument according to claim 3, in which said valve is provided with through holes provided in the head in the vicinity of the tab.

7. A writing instrument according to claim 3, in which said inker element is continuously in contact with the tab.

8. A writing instrument according to claim 3, in which said inker element is movable between a writing position in which it urges said valve towards an open position to allow the ink to flow, and a rest position in which it allows said valve to occupy a closed position.

9. A writing instrument according to claim 3, in which said feeder device comprises a sleeve in which the opening is formed, wherein the sleeve is engaged on a nozzle of the reservoir and has said valve mounted therein.

10. A writing instrument according to claim 3, in which said valve is provided with through holes provided in the head in the vicinity of the tab.

11. A writing instrument according to claim 3, in which said inker element is continuously in contact with the tab.

12. A writing instrument according to claim 3, in which said inker element is movable between a writing position in which it urges said valve towards an open position to allow the ink to flow, and a rest position in which it allows said valve to occupy a closed position.

13. A writing instrument according to claim 1, in which said duct is rectangular in section, the tab being pyramid-shaped.

14. A writing instrument according to claim 1, in which said feeder device further comprises a sleeve in which the opening is formed, wherein the sleeve is engaged on a nozzle of the reservoir and has said valve mounted therein.

15. A writing instrument according to claim 1, in which said valve is provided with through holes provided in the head in the vicinity of the tab.

16. A writing instrument according to claim 15, in which the holes are in the form of slots having parallel edges, said valve presenting a peripheral portion that is stationary relative to said body and a central portion including the tab, the central portion being movable between a closed position in which the edges of each slot coincide, and an open position in which the edges of the slots are offset so as to allow the ink to flow.

17. A writing instrument according to claim 1, in which said inker element is continuously in contact with the tab.

18. A writing instrument according to claim 1, in which the support is urged towards the rest position by a return spring.

19. A writing instrument according to claim 18, in which the return spring comprises a spring blade integrated in the support and bearing against a wall that is stationary relative to said body.

20. A writing instrument according to claim 1, in which said body extends along a main axis, and said inker element is a roller mounted to rotate about an axis that is perpendicular to the main axis.

21. A writing instrument according to claim 20, in which said inker element is in peripheral contact with a writing roller mounted to rotate about an axis parallel to the axis of the intermediate roller, and suitable for coming into contact with a writing medium.

22. A writing instrument according to claim 21, in which the diameter of the inker roller is smaller than the diameter of the writing roller.

23. A writing instrument comprising:

a body provided having an ink reservoir;

an inker element mounted on said body; and a feeder device comprising:

a duct connecting the reservoir to said inker element and opening out into the reservoir via an opening, said duct presenting an inside wall; and a valve having a tab received in said duct, the tab being extended by a head, wherein said valve is mounted to slide between a closed position in which the head is pressed against a shoulder bordering the opening so as to prevent ink from flowing, and an open position in which the head is located at least in part away from the shoulder so as to enable ink to flow through the opening, wherein a gap is formed between the tab and the inside wall of said duct, and wherein the tab projects from said duct towards said inker element, and wherein said duct is rectangular in section, the tab being pyramid-shaped.

24. A writing instrument comprising:

a body provided having an ink reservoir;

an inker element mounted on said body; and a feeder device comprising:

a duct connecting the reservoir to said inker element and opening out into the reservoir via an opening, said duct presenting an inside wall; and a valve having a tab received in said duct, the tab being extended by a head wherein said valve is mounted to slide between a closed position in which the head is pressed against a shoulder bordering the opening so as to prevent ink from flowing, and an open position in which the head is located at least in part away from the shoulder so as to enable ink to flow through the opening, wherein a gap is formed between the tab and the inside wall of said duct, wherein the tab projects from said duct towards said inker element, wherein said valve is provided with through holes provided in the head in the vicinity of the tab, wherein said inker element is movable between a writing position in which it urges said valve towards an open position to allow the ink to flow, and a rest position in which it allows said valve to occupy a closed position, and wherein said inker element is secured on a support mounted to slide relative to said body between a writing position in which said inker element urges said valve towards an open position to allow the ink to flow, and a rest position in which said inker element enables said valve to occupy a closed position.

* * * * *